US009038924B2

(12) United States Patent
Lo

(10) Patent No.: US 9,038,924 B2
(45) Date of Patent: May 26, 2015

(54) NOZZLE ASSEMBLY FOR SPRINKLER

(75) Inventor: Shun-Nan Lo, Taichung (TW)

(73) Assignee: YUAN-MEI CORP., Taichung (TW)

( * ) Notice: Subject to any disclaimer, the term of this patent is extended or adjusted under 35 U.S.C. 154(b) by 368 days.

(21) Appl. No.: 12/662,579

(22) Filed: Apr. 23, 2010

(65) Prior Publication Data

US 2011/0259975 A1 Oct. 27, 2011

(51) Int. Cl.

| | |
|---|---|
| ***B05B 1/30*** | (2006.01) |
| ***B05B 1/26*** | (2006.01) |
| ***B05B 15/06*** | (2006.01) |
| *B05B 15/10* | (2006.01) |

(52) U.S. Cl.

CPC ..... *B05B 1/3013* (2013.01); *B05B 1/262* (2013.01); *B05B 15/066* (2013.01); *B05B 15/10* (2013.01)

(58) Field of Classification Search

CPC ..... B05B 1/083; B05B 1/18; B05B 3/04; B05B 12/06; B05B 15/066

USPC ..... 239/99, 491, DIG. 1; 251/215, 38

See application file for complete search history.

(56) References Cited

U.S. PATENT DOCUMENTS

| | | | | |
|---|---|---|---|---|
| 239,355 | A * | 3/1881 | Rappold | 122/271 |
| 5,226,599 | A * | 7/1993 | Lindermeir et al. | 239/205 |
| 6,085,995 | A * | 7/2000 | Kah et al. | 239/237 |

* cited by examiner

*Primary Examiner* — Len Tran

*Assistant Examiner* — Viet Le

(74) *Attorney, Agent, or Firm* — Raymond Y. Chan; David and Raymond Patent Firm

(57) ABSTRACT

A nozzle assembly for a sprinkler is revealed. The nozzle assembly includes a main channel having a water inlet on one end and a water outlet on the other end thereof The nozzle assembly features on that: an adjustment member for control of water flow is disposed on the main channel, located between the water inlet and the water outlet. The adjustment member is arranged around the main channel. The displacement direction of the adjustment member and the water flow direction of the main channel are not along the same axis, or not parallel to each other. Thus when the nozzle assembly is applied to underground sprinklers; it is hidden from view and is able to prevent others from changing outlet water flow purposely.

8 Claims, 11 Drawing Sheets

NOZZLE ASSEMBLY FOR SPRINKLER

BACKGROUND OF THE INVENTION

1. Fields of the Invention

The present invention relates to a nozzle assembly for a sprinkler, especially to a nozzle assembly for a sprinkler that can provide on-off control of water and regulate the amount of water output.

2. Descriptions of Related Art

A nozzle assembly for conventional underground sprinklers is revealed. Refer to U.S. Pat. No. 5,086,977 "SPRINKLER DEVICE", underground sprinklers in which water pressure causes a pop-up riser means being moved to its extend or retracted position are disclosed. A nozzle assembly is mounted in an axially movable nozzle housing assembly that is received in a cylindrical housing. An opening is formed in the outer surface of the nozzle housing and a nozzle is inserted through the opening into the nozzle housing assembly. The top of a cylindrical member of the riser means has an adjusting slot for setting the desired oscillating angle for the sprinkler. After water flowing through, the nozzle assembly is popped up slowly to a preset position and then water is ejected from the nozzle.

The amount of water output though the above nozzle assembly is unable to be adjusted. Thus the water flow ejected out from the nozzle assembly is delivered to a certain range. The water flow is unable to be modified according to terrain and users' requirements.

A nozzle assembly with adjustable water output has been developed and invented based on the structure of the above underground sprinklers. Refer to U.S. Pat. No. 6,241,158 "Irrigation sprinkler with pivoting throttle valve" and U.S. Pat. No. 6,050,502 "Rotary sprinkler with memory arc mechanism and throttling valve", a pivotable arc valve body is arranged on a vertical water channel, located in a riser just below the nozzle. The arc valve is pivotable between two positions by manually turning a drive member with a hand tool. When the valve body pivots to its first (vertical) position, the water flow path is substantially open while the valve body substantially obstructs the water flow path when it pivots to a second (horizontal) position.

Although the above nozzle assemblies provide functions of on-off and water flow adjustment, they still have following shortcomings:

1. The arc valve body of the nozzle assembly is set and pivoted in the vertical water channel. The space inside the vertical water channel is small and narrow and this causes difficulties in assembling the arc valve body.
2. Through a gear drive assembly operated by a hand tool, the nozzle is rotated by the arc valve body in above two patents. Thereby the operation of the drive assembly is not smooth once the connection between the drive member and the arc valve body is poor. On the other hand, once the connection therebetween is good, the arc valve body is difficult to be located precisely. When the arc valve body is in the closed position, it is easy to be moved due to flow pressure and the water flow path is opened automatically.
3. The drive member is mounted in the upper end of the nozzle assembly and is parallel to the vertical water channel of the nozzle assembly. Thus the top of a driving end of the drive member is exposed on a top surface of the nozzle assembly for convenience of moving and adjusting the drive member. However, everyone can easily change the water flow if he intends and there is no protection design.

Thus there is a space to improve the nozzle assembly available now and a need to provide the nozzle assembly with novel design.

SUMMARY OF THE INVENTION

Therefore it is a primary object of the present invention to provide a sprinkler nozzle that is able to regulate the outlet water flow.

In order to achieve the above object, a nozzle assembly for a sprinkler according to the present invention is disposed on a top of an inner tube of a sprinkler. A vertical main channel is arranged along an axis of the nozzle assembly. A water inlet connected with a water source for water supply is arranged at the bottom of the main channel while a water outlet is set on one side of the other end of the main channel. An adjustment member for control of water flow is disposed on the main channel, located between the water inlet and the water outlet. A side hole set on the main channel is connected with a ring while an inner threaded section is arranged near an outer end of an inner bore of the ring. The adjustment member is a cylinder in which one end is a conical frustum having maximum outside diameter larger than the outside diameter of the cylinder and the other end is a slot. The conical frustum is for closing the water outlet while the slot is used to assemble with driving devices. An outer threaded section and a ring groove are respectively arranged on a surface of one end of the adjustment member having the slot. The outer threaded section is threaded with the inner threaded section of the ring while the ring groove is for receiving a sealing ring whose outer part is closely attached to the inner bore of the ring.

In accordance with the above structure and parts, the diameter of a flow path opened from the main channel to the water outlet is controlled by the displacement of the adjustment member so as to regulate output water flow.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 6:
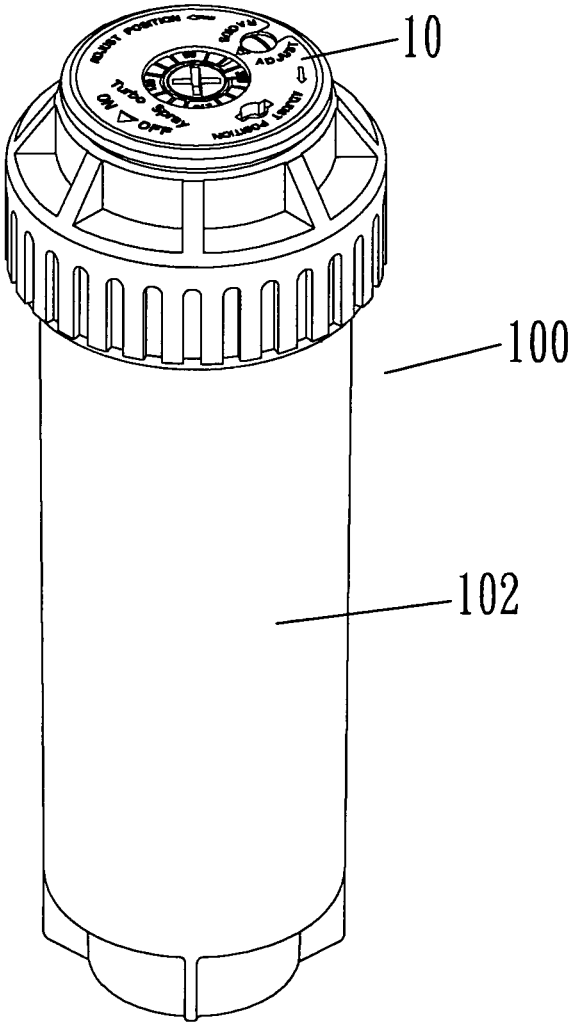
FIG. 6 is a schematic drawing showing an embodiment of the present invention assembled to a sprinkler.
Figure 7:
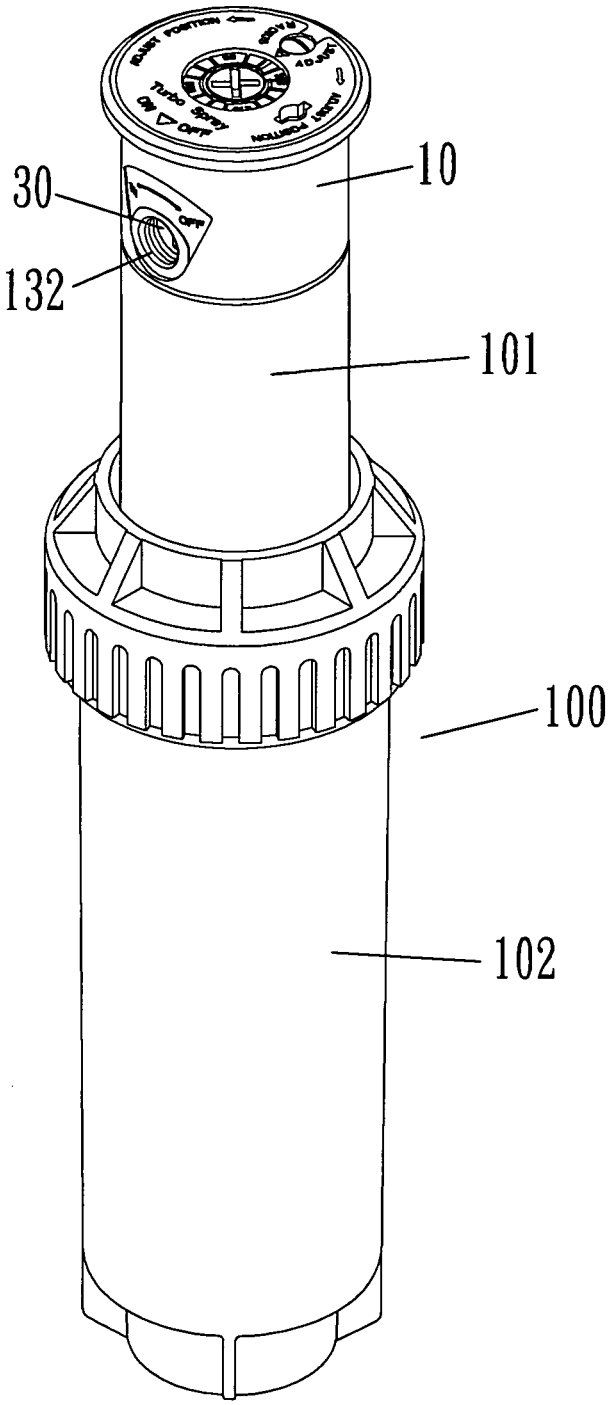
FIG. 7 is another schematic drawing showing an embodiment of the present invention assembled to a sprinkler.

Refer to FIG. 7, a nozzle assembly 10 for a sprinkler is connected on a top of an inner tube 101 of a sprinkler 100 shown in FIG. 6 and FIG. 7. The above mentioned inner tube 101 is mounted in an outer tube 102 of the sprinkler 100. The inner tube 101 is moved up and down automatically by water pressure. After water being turned off, the inner tube 101 is retracted into the outer tube 102. A water outlet 112 arranged at one side of the nozzle assembly 10 on top of the inner tube 101 is also hidden inside the outer tube 102, not exposed. The connection between the sprinkler 100 and the nozzle assembly 10 is similar to that in prior arts.

The nozzle assembly 10 of the present invention features on that: a vertical main channel 11 is disposed along an axis of the nozzle assembly 10. A water inlet 111 connected with a water source for water supply is arranged at the bottom of the main channel 11 while the water outlet 112 is disposed on one side of the other end of the main channel 11. A nozzle 20 is disposed on a front end of the water outlet 112. An adjustment member 30 that controls water flow is arranged at the main channel 11, between the water inlet 111 and the water outlet 112. The water outlet 112 is closed or opened by displacement of the adjustment member 30. The flow path diameter opened is also controlled by the adjustment member 30.

In this embodiment, the connection between the nozzle assembly 10 and the adjustment member 30 is as following. A side hole 12 is disposed on the main channel 11 of the nozzle assembly 10 and is connected with a ring 13. An inner threaded section 132 is set near an outer end of an inner bore 131 of the ring 13. The ring 13 is integrated with the side hole 12 by high frequency induction heating.

The adjustment member 30 is a cylinder in which one end is a conical frustum 31 whose maximum outside diameter is larger than the outside diameter of the cylinder while the other end is a slot 32. The conical frustum 31 is used to close the water outlet 112 while the slot 32 is for mounting driving devices (not shown in figure). An outer threaded section 33 and a ring groove 34 are respectively arranged around the surface of one end of the adjustment member 30 with the slot 32. The outer threaded section 33 is threaded with the inner threaded section 132 of the ring 13. A sealing ring 341 is mounted in the ring groove 34 and an outer part of the sealing ring 341 is closely attached to the inner bore 131 of the ring 13.

Figure 1:
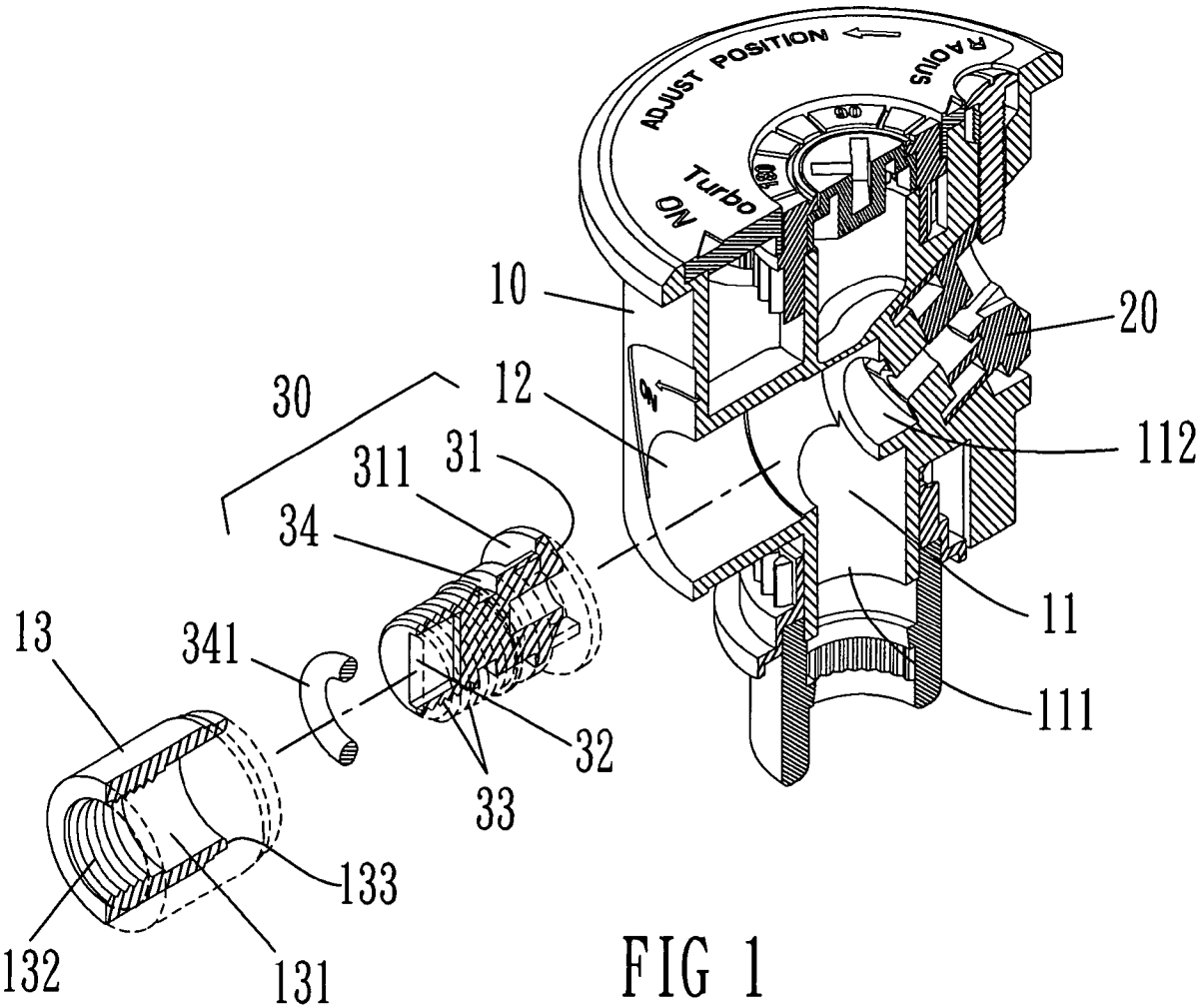
FIG. 1 is an explosive cross-sectional view of an embodiment according to the present invention.
Figure 2:
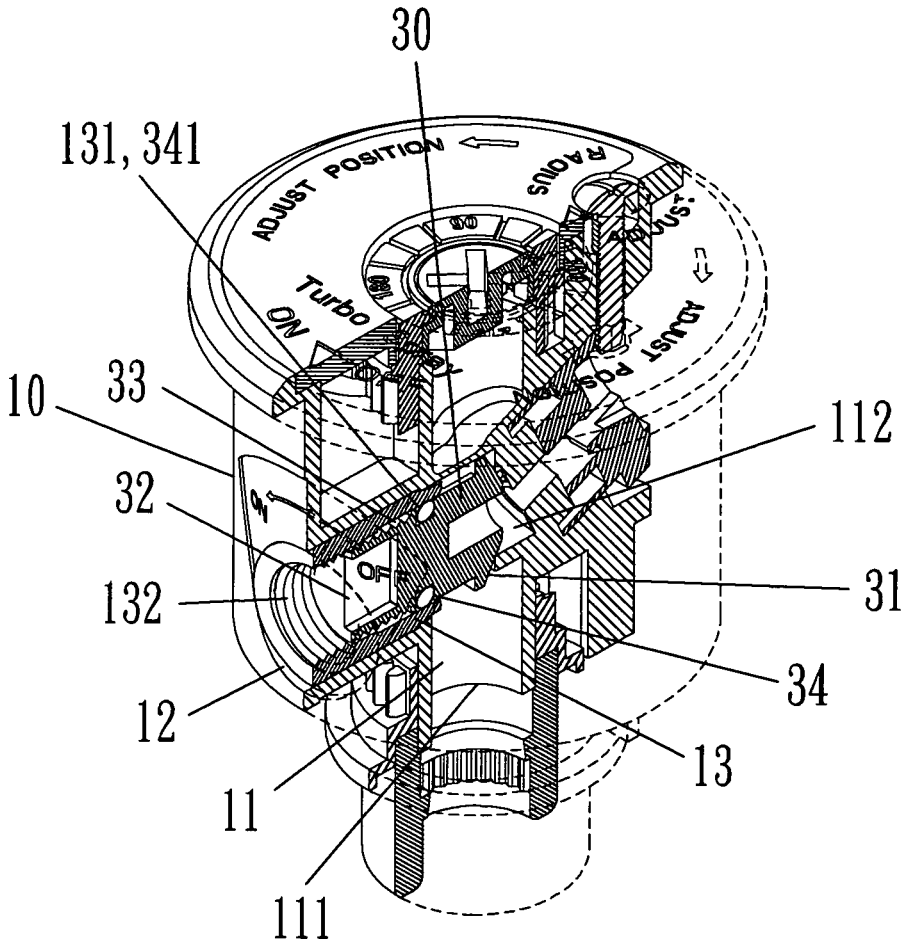
FIG. 2 is assembled cross sectional view of an embodiment according to the present invention.
Figure 3:
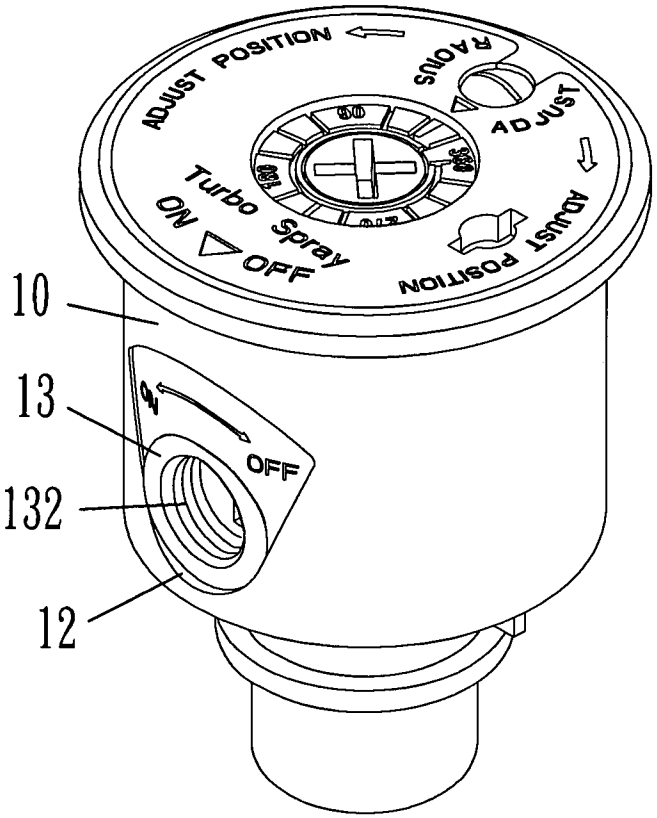
FIG. 3 is a perspective view of an embodiment according to the present invention.
Figure 4:
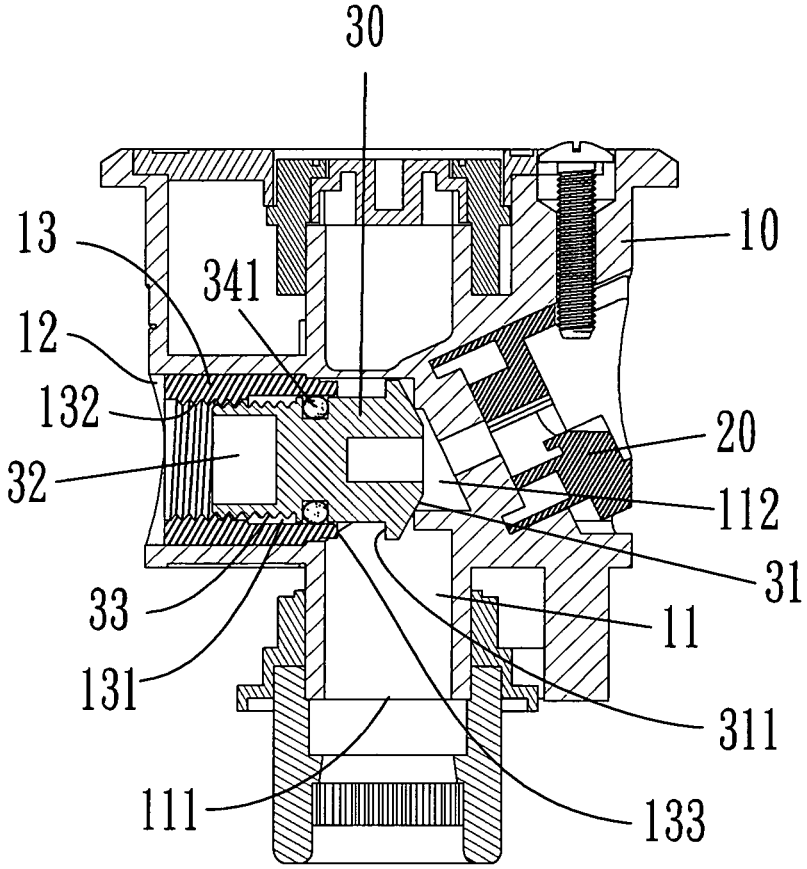
FIG. 4 is a side cross sectional view of an embodiment according to the present invention.
Figure 5:
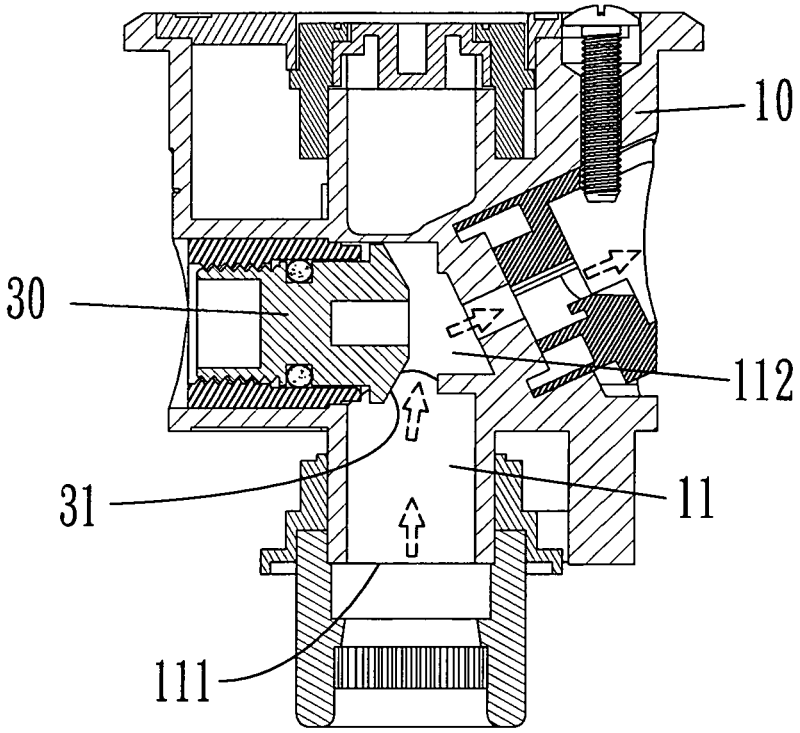
FIG. 5 is a schematic drawing showing action of the embodiment in FIG. 4.

According to the structure formed by above components, as shown in FIG. 4 and FIG. 5, while rotating the adjustment member 30, it is driven to move horizontally. Thereby the conical frustum 31 of the adjustment member 30 is also moved to open or close the water outlet 112. Moreover, the diameter of the path from the main channel 11 to the water outlet 112 is controlled by the adjustment member 30 so as to regulate output water flow.

The ring 13 is connected to the side hole 12 on the main channel 11 of the nozzle assembly 10. Then the adjustment member 30 is threaded into the ring 13 and the conical frustum 31 whose maximum outside diameter is larger than the outside diameter of the adjustment member 30 is arranged at one end of the adjustment member 30. Thus a side end surface 311 of the conical frustum 31 beside the adjustment member 30 is against an inside end surface 133 of the ring 13 correspondingly. Thereby the adjustment member 30 will not be released from the ring 13 during the displacement process.

Figure 8:
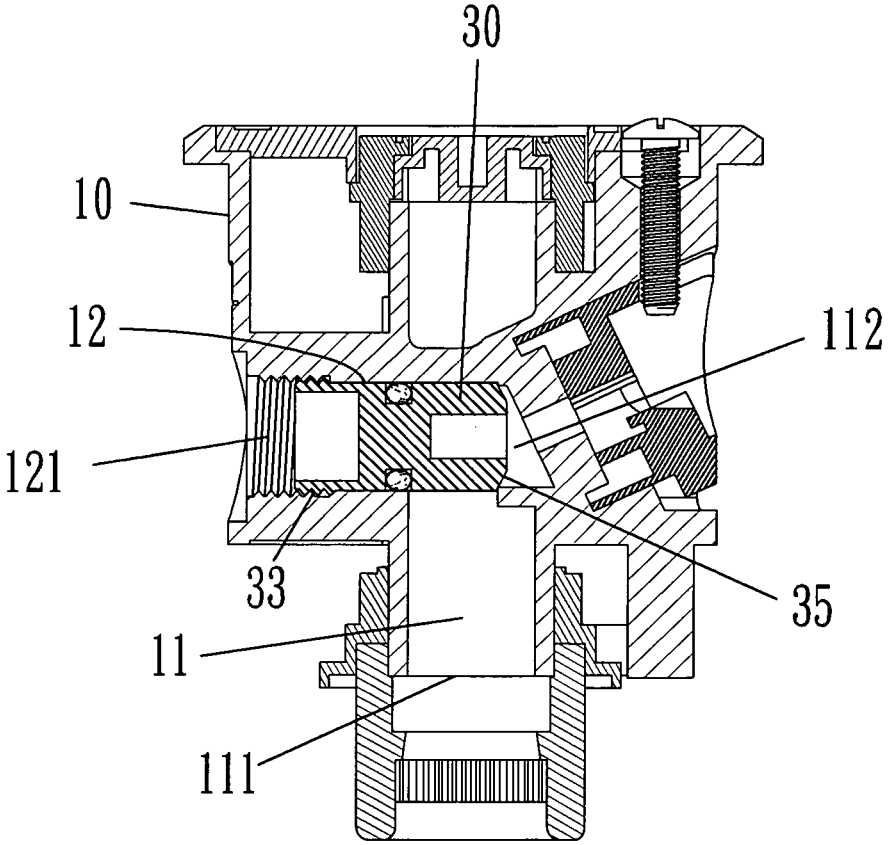
FIG. 8 is side cross sectional view of another embodiment according to the present invention.

As shown in FIG. 8, another embodiment of the present invention is revealed. An inner threaded hole 121 is disposed near an outer end of the side hole 12. Thus the adjustment member 30 with the outer threaded section 33 can be threaded with the inner threaded hole 121 directly. Moreover, a curved surface 35 is arranged at one end of the adjustment member 30 that faces the water outlet 112 for closing the water outlet 112. Thereby the output water flow can also be adjusted and controlled.

Figure 9:
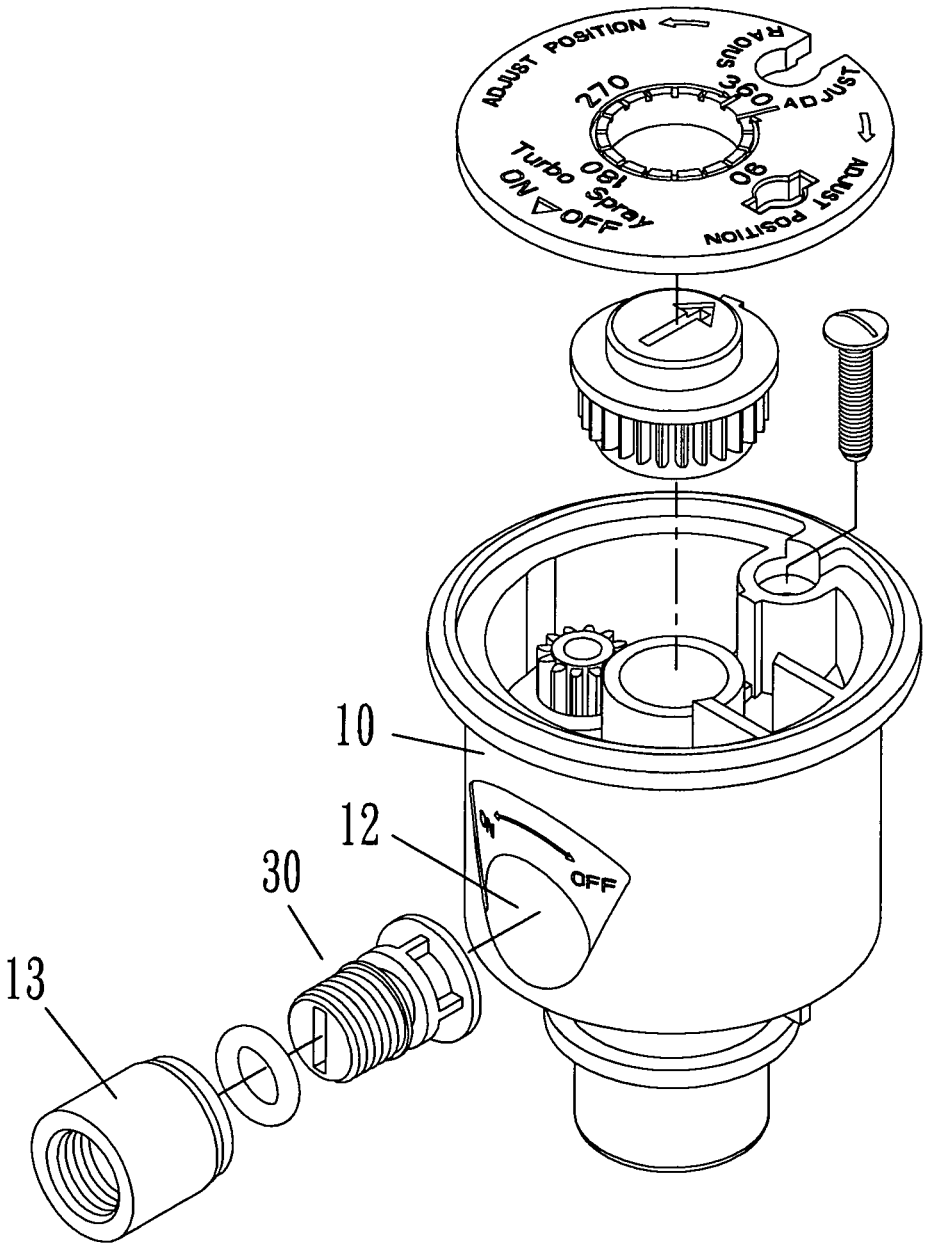
FIG. 9 is an explosive view of a further embodiment according to the present invention.
Figure 10:
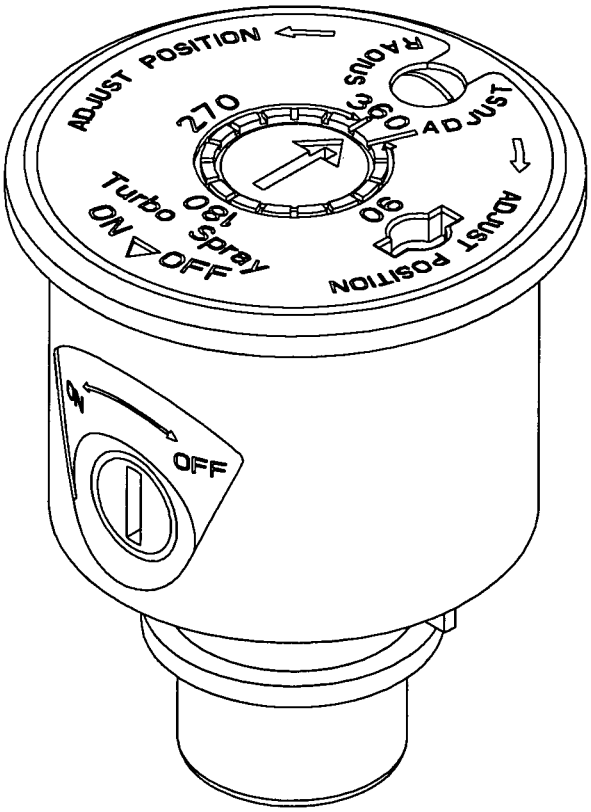
FIG. 10 is an assembled view of the embodiment in FIG. 9.
Figure 11:
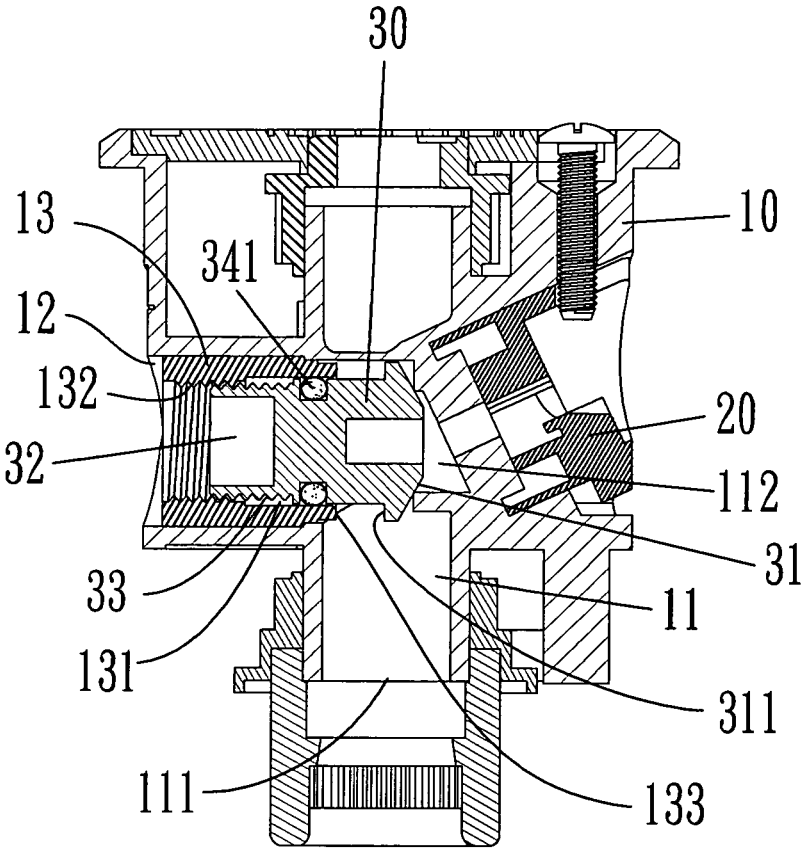
FIG. 11 is an assembled cross sectional view of the embodiment in FIG. 9.

Furthermore, refer from FIG. 9 to FIG. 11, a further embodiment is disclosed. The difference between this embodiment and above two is in that: the structure of the nozzle assembly 10 that is assembled with the adjustment member 30. That means differences in designs of parts for connection in an upper open end of the nozzle assembly 10.

In summary, the direction of displacement of the adjustment member and the direction of the water flow in the main channel of the nozzle assembly are crossed. In this embodiment, the directions are perpendicular to each other. Or there is a certain angle between the two directions. The adjustment member is connected and assembled around the nozzle assembly. Thereby after the nozzle assembly being hidden in the outer tube of the sprinkler, the outlet water flow is unable to be changed by others purposely.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A device for a sprinkler which comprises an outer tube and an inner tube which is mounted in said outer tube in such a manner that said inner tube is moved up and down automatically by water pressure, wherein said device, which is arranged for being connected to said inner tube, comprises:

a nozzle assembly having a vertical main channel and defining a water inlet at a bottom of said main channel and a water outlet at one side of said nozzle assembly at the outer end of said main channel, wherein said nozzle assembly further has a side hole formed at a transverse side of said main channel;

a nozzle provided at said water outlet of said nozzle assembly; and an adjustment member, which is horizontally coupled with said main channel, selectively closing said water outlet and controlling a diameter of a flow path of said main channel to selectively control a flow volume of water to said nozzle, wherein said adjustment member is formed in cylindrical shape to define a cylinder and a conical frustum and is threaded inside said side hole of said nozzle assembly, wherein a diameter of said conical frustum is larger than a diameter of said cylinder, wherein one end of said adjustment member is arranged for closing said water outlet while the other end thereof is provided with a slot for being rotated and driven, wherein said nozzle assembly is arranged for being hidden within said outer tube when said inner tube is retracted into said outer tube, so as to hide said side hole of said nozzle assembly and said slot of said adjustment member therewithin, wherein when said inner tube is moved upwardly to expose out of said outer tube, said adjustment member is enabled to drive to rotate within said side hole in order to move said adjustment member to close said water outlet, wherein said nozzle assembly comprises a ring secured in said side hole of said nozzle assembly and defined an inner threaded section and an inner bore, wherein said adjustment member has an outer threaded section which is formed at said cylinder and is engaged with said inner threaded section of said ring and is arranged in such a manner that when said adjustment member is driven to rotate, said conical frustum is moved to close said water outlet, wherein said conical frustum has a side end surface arranged to bias against an end surface of said ring when said conical frustum is moved away from said water outlet to prevent said adjustment member being released from said ring.

2. The device, as recited in claim 1, wherein said adjustment member further has a ring groove formed at an outer surface thereof and a sealing ring mounted at said ring groove, wherein when said outer threaded section of said adjustment member is engaged with said inner threaded section of said ring, said sealing ring is sealed at and engaged with said inner bore of said ring.

3. The device, as recited in claim 2, wherein a direction of displacement of said adjustment member and a direction of a vertical water flow in said main channel of said nozzle assembly are crossed.

4. The device, as recited in claim 1, wherein said adjustment member further has a ring groove formed at an outer surface thereof and a sealing ring mounted at said ring groove, wherein when said outer threaded section of said adjustment member is engaged with said inner threaded section of said side hole, said sealing ring is sealed at and engaged with said inner bore of said side hole.

5. A sprinkler, comprising:

an outer tube;

an inner tube mounted in said outer tube, wherein said inner tube is moved up and down automatically by means of water pressure;

a nozzle assembly, which is arranged for being connected to said inner tube, having a vertical main channel and defining a water inlet at a bottom of said main channel and a water outlet at one side of said nozzle assembly at the outer end of said main channel, wherein said nozzle assembly further has a side hole formed at a transverse side of said main channel;

a nozzle provided at said water outlet of said nozzle assembly; and an adjustment member, which is horizontally coupled with said main channel, selectively closing said water outlet and controlling a diameter of a flow path of said main channel to selectively control a flow volume of water to said nozzle, wherein said adiustment member is formed in cylindrical shape to define a cylinder and a conical frustum and is threaded inside said side hole of said nozzle assembly, wherein a diameter of said conical frustum is larger than a diameter of said cylinder, wherein one end of said adiustment member is arranged for closing said water outlet while the other end thereof is provided with a slot for being rotated and driven, wherein said nozzle assembly is arranged for being hidden within said outer tube when said inner tube is retracted into said outer tube, so as to hide said side hole of said nozzle assembly and said slot of said adiustment member therewithin, wherein when said inner tube is moved upwardly to expose out of said outer tube, said adiustment member is enabled to drive to rotate within said side hole in order to move said adiustment member to close said water outlet;

wherein said nozzle assembly comprises a ring secured in said side hole of said nozzle assembly and defined an inner threaded section and an inner bore, wherein said adjustment member has an outer threaded section which is formed at said cylinder and is engaged with said inner threaded section of said ring and is arranged in such a manner that when said adjustment member is driven to rotate, said conical frustum is moved to close said water outlet, wherein said conical frustum has a side end surface arranged to bias against an end surface of said ring when said conical frustum is moved away from said water outlet to prevent said adjustment member being released from said ring.

6. The sprinkler, as recited in claim 5, wherein said adjustment member further has a ring groove formed at an outer surface thereof and a sealing ring mounted at said ring groove, wherein when said outer threaded section of said adjustment member is engaged with said inner threaded section of said ring, said sealing ring is sealed at and engaged with said inner bore of said ring.

7. A sprinkler, comprising:

an outer tube;

an inner tube mounted in said outer tube, wherein said inner tube is moved up and down automatically by means of water pressure;

a nozzle assembly, which is arranged for being connected to said inner tube, having a vertical main channel and defining a water inlet at a bottom of said main channel and a water outlet at one side of said nozzle assembly at the outer end of said main channel, wherein said nozzle assembly further has a side hole formed at a transverse side of said main channel;

a nozzle provided at said water outlet of said nozzle assembly; and an adiustment member, which is horizontally coupled with said main channel, selectively closing said water outlet and controlling a diameter of a flow path of said main channel to selectively control a flow volume of water to said nozzle, wherein said adiustment member is formed in cylindrical shape to define a cylinder and a conical frustum and is threaded inside said side hole of said nozzle assembly, wherein a diameter of said conical frustum is larger than a diameter of said cylinder, wherein one end of said adiustment member is arranged for closing said water outlet while the other end thereof is provided with a slot for being rotated and driven, wherein said nozzle assembly is arranged for being hidden within said outer tube when said inner tube is retracted into said outer tube, so as to hide said side hole of said nozzle assembly and said slot of said adiustment member therewithin, wherein when said inner tube is moved upwardly to expose out of said outer tube, said adiustment member is enabled to drive to rotate within said side hole in order to move said adiustment member to close said water outlet;

wherein said side hole of said nozzle assembly has an inner threaded section and an inner bore, wherein said adjustment member has an outer threaded section which is formed at said cylinder and is engaged with said inner threaded section of said side hole and is arranged in such a manner that when said adjustment member is driven to rotate, said conical frustum is moved to closed said water outlet, wherein said conical frustum has a side end surface arranged to bias against an end surface of said ring when said conical frustum is moved away from said water outlet to prevent said adjustment member being released from said ring.

8. The sprinkler, as recited in claim 7, wherein said adjustment member further has a ring groove formed at an outer surface thereof and a sealing ring mounted at said ring groove, wherein when said outer threaded section of said adjustment member is engaged with said inner threaded section of said side hole, said sealing ring is sealed at and engaged with said inner bore of said side hole.

* * * * *